US007083140B1

(12) United States Patent
Dooley

(10) Patent No.: US 7,083,140 B1
(45) Date of Patent: Aug. 1, 2006

(54) FULL-BORE ARTILLERY PROJECTILE FIN DEVELOPMENT DEVICE AND METHOD

(75) Inventor: Robert B. Dooley, Canton, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/939,418

(22) Filed: Sep. 14, 2004

(51) Int. Cl.
*F42B 10/14* (2006.01)

(52) U.S. Cl. ..... 244/3.27; 244/3.1; 244/3.24; 244/45 R; 244/46; 244/49; 102/501

(58) Field of Classification Search ..... 244/3.1–3.3, 244/34 R, 35 R, 45 R, 46, 49; 102/510–528; 89/1.11

See application file for complete search history.

(56) References Cited

U.S. PATENT DOCUMENTS

| | | | | | |
|---|---|---|---|---|---|
| 2,801,587 | A | | 8/1957 | Gould | |
| 3,347,491 | A | * | 10/1967 | Auguste et al. | 244/3.27 |
| 3,515,360 | A | * | 6/1970 | Alexander | 244/3.28 |
| 3,819,132 | A | * | 6/1974 | Rusbach | 244/3.28 |
| 4,175,720 | A | | 11/1979 | Craig | |
| 4,717,093 | A | * | 1/1988 | Rosenberger et al. | 244/49 |
| 4,884,766 | A | * | 12/1989 | Steinmetz et al. | 244/3.27 |
| 5,326,049 | A | | 7/1994 | Rom et al. | |
| 5,480,111 | A | * | 1/1996 | Smith et al. | 244/3.27 |
| 5,820,072 | A | * | 10/1998 | Na et al. | 244/49 |
| 5,829,715 | A | * | 11/1998 | Banks | 244/49 |
| 6,092,264 | A | * | 7/2000 | Banks | 244/3.27 |
| 6,314,886 | B1 | | 11/2001 | Kuhnle et al. | |
| 6,446,906 | B1 | * | 9/2002 | Voigt et al. | 244/3.27 |
| 6,880,780 | B1 | * | 4/2005 | Perry et al. | 244/3.27 |

FOREIGN PATENT DOCUMENTS

| | | |
|---|---|---|
| WO | WO 01/79779 | 10/2001 |

* cited by examiner

*Primary Examiner*—Bernarr E. Gregory
(74) *Attorney, Agent, or Firm*—William V. Adams

(57) ABSTRACT

A method and structure for a full-bore artillery projectile fin deployment device comprising a projectile stabilization fin comprising an aperture and a movable pawl; a rod comprising a head portion and a shaft portion terminating with a beveled tip configured for engaging the pawl; a tailboom configured for housing the fin, wherein the tailboom comprises a hollow bore configured for receiving the rod; a pin slotted through the aperture and attached to the tailboom; and a bias member adjacent to the head portion of the rod. The rod is slotted to simultaneously engage a plurality of fins. The tailboom comprises a forward end and a rearward end and a slot configured for permitting the fin to articulate out of the tailboom, and wherein the tailboom connects to a projectile. Additionally, the power source for the device is the naturally occurring launch accelerations.

26 Claims, 14 Drawing Sheets

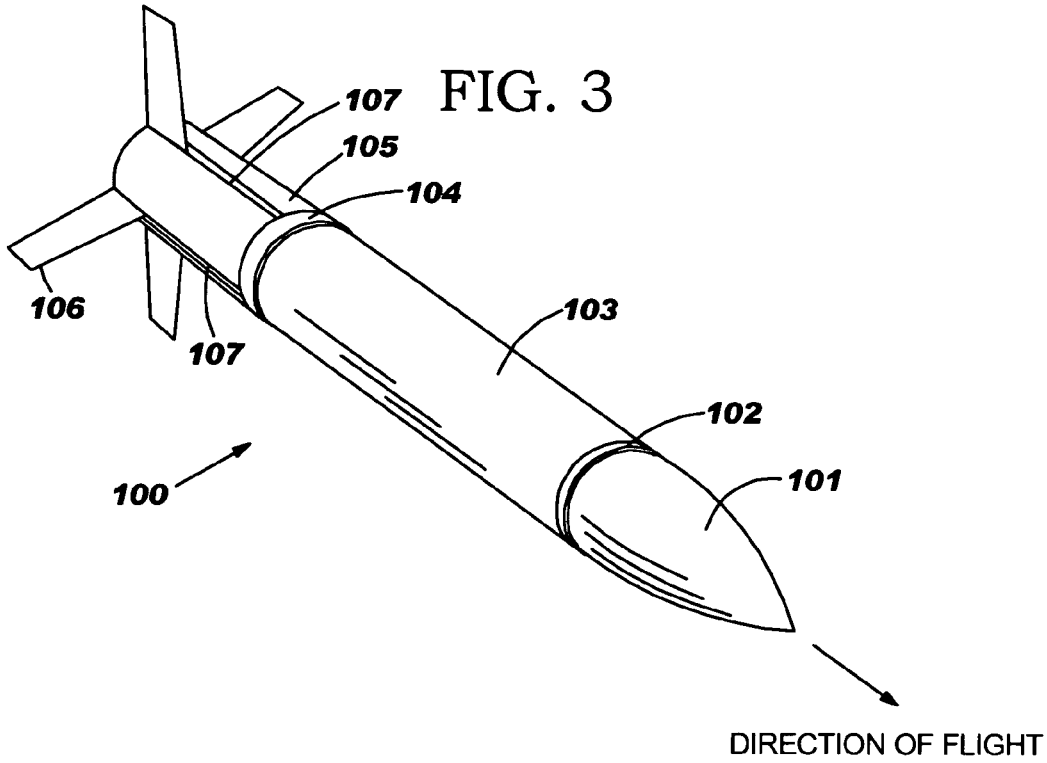
FIG. 3
FIG. 4
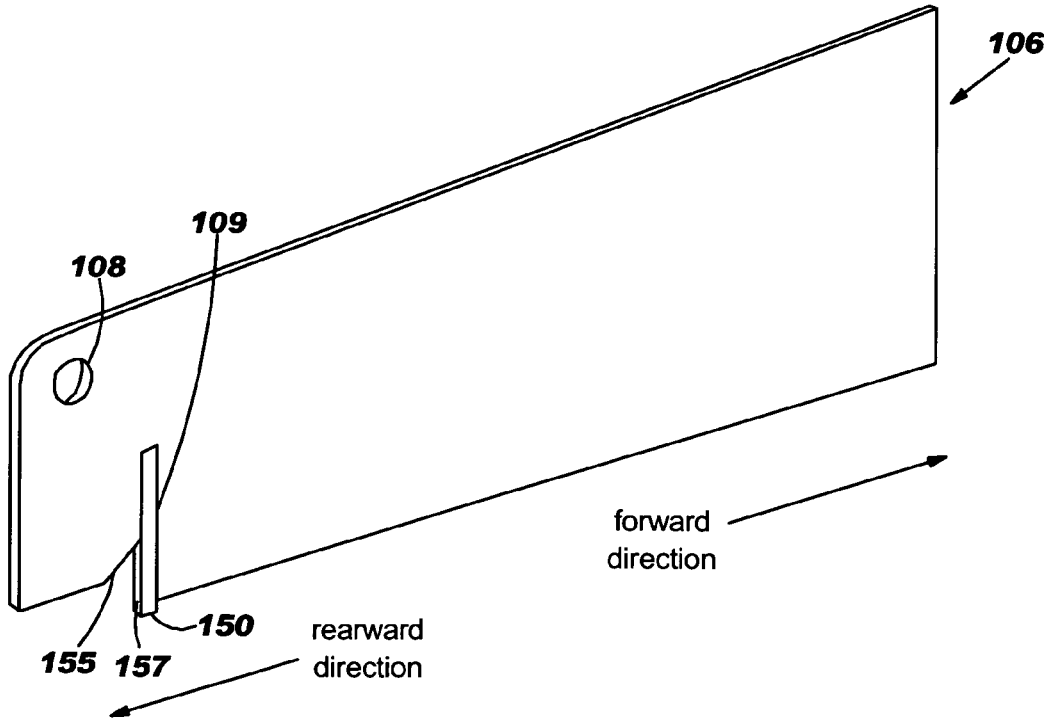

FULL-BORE ARTILLERY PROJECTILE FIN DEVELOPMENT DEVICE AND METHOD

GOVERNMENT INTEREST

The invention described herein may be manufactured, used, and/or licensed by or for the United States Government.

BACKGROUND OF THE INVENTION

1. Field of the Invention

The invention generally relates to guided projectiles, and more particularly to a fin-stabilized guided projectile.

2. Description of the Related Art

Generally, artillery projectiles launched from cannons require mechanical and aerodynamic stabilization to assure a predictable trajectory. Until recently, most artillery projectiles were generally stabilized by means of angular momentum (spinning inertia). This technique commonly referred to as spin stabilization, is achieved by spinning the projectile about its longitudinal axis as it translates along the bore of the cannon. FIG. 1 shows an example of the general configuration of a conventional spin stabilized projectile consisting of an ogive 1 adjacent to a forward bore rider 2, which is next to a shell body 3 that is adjacent to an obturating (gas-sealing) rotating band 4, which is adjacent to a tailboom 5 all formed and spinning about the longitudinal axis of the spin stabilized projectile during flight. This rotation (spin) motion is achieved by mechanical contact between the helical rifling grooves and lands engraved on the surface of the cannon bore mating with a deformable metallic or polymeric ring of material, referred to as the rotating band 4 mounted on the rear of the projectile.

In practice, this motion causes the projectile to spin about the longitudinal axis of the projectile thereby acquiring some magnitude of angular momentum that is conserved (retained) as the projectile exits the muzzle. One disadvantage associated with the spin stabilization method is the potential for excessive angular acceleration imparted to the entire projectile. The associated axial and centrifugal loads may result in prohibitively high inertial forces acting on projectile components.

Additionally, the potential to over-stabilize the projectile, which may prevent tip-over at the point of apogee, exists with spin-stabilized projectiles. In these cases, the projectile may approach or impact the target at an orientation other than nose (ogive 1) first thereby resulting in a malfunction and a failed or delayed detonation. Another characteristic of over-stabilized projectiles is their tendency to drift off their intended trajectories resulting in excessive dispersion and/or unintended collateral damage.

Artillery projectile designers have applied the fin stabilization technique in an effort to diminish or eliminate some of the disadvantages associated with spin-stabilized projectiles. Fin-stabilized projectiles have the advantage of operating in a uniaxial acceleration loading environment (as opposed to the dual acceleration environment, axial and angular, of the spin-stabilized projectiles). FIG. 2 shows a conventional fin-stabilized projectile with the fins 6 configured as they would be during flight.

Fin stabilization has proven successful in the past and is considered an enhancement to both direct fire and indirect fire munitions. One of the major advantages to this technique is that a single smoothbore cannon can be used conventionally for high velocity direct fire fin stabilized kinetic energy penetrators (mounted in sabots) in addition to launching the relatively lower velocity full bore indirect fire artillery projectiles.

A disadvantage of the fin stabilization method is that the fins must be capable of assuming a stowed configuration for translation through the bore of the cannon during launch, and a deployed configuration for aerodynamic stability during flight. Conventional full-bore fin stabilized artillery projectiles usually employ some form of a complex mechanism requiring on-board energy sources or powered mechanisms such as electric batteries, motors, solenoids, squibs (explosives) or spring-loaded (pre-compressed) mechanical devices. Some potential complications associated with these devices include a possible requirement that they integrate precise timing mechanisms or electrical circuits to activate and deploy the fins within a short distance after the projectile exits the muzzle of the cannon. Therefore, there remains a need for a novel full-bore artillery projectile fin deployment mechanism which is not dependent on the use of any electromechanical or complicated stored potential energy actuation devices.

SUMMARY OF THE INVENTION

In view of the foregoing, an embodiment of the invention provides a full-bore artillery projectile fin deployment device comprising at least one projectile stabilization fin comprising an aperture and a movable pawl; a rod comprising a head portion and a shaft portion terminating with a beveled tip configured for engaging the pawl; a tailboom configured for housing the fin, wherein the tailboom comprises a hollow bore configured for receiving the rod; a pin slotted through the aperture of the fin and attaching the fin to the tailboom; and a bias member adjacent to the head portion of the rod. In one embodiment, the rod is slotted to simultaneously engage a plurality of fins. The tailboom comprises a forward end and a rearward end and a slot configured for permitting the fin to articulate out of the tailboom, and wherein the tailboom connects to a projectile.

Additionally, the tailboom further comprises a receptacle configured for housing the bias member and a boss configured for limiting the rods translation in the direction towards the rearward end of the tailboom. Moreover, propulsion of the projectile exerts acceleration loads on the rod, wherein the (pressure) causes the rod to translate in a direction towards the rearward end of the tailboom thereby causing the rod to engage the pawl, and wherein the (pressure) causes the head portion of the rod to apply a compressive force on the bias member configured for storing energy. The bias member is configured for releasing stored energy thereby causing the rod to translate in a direction towards the forward end of the tailboom, wherein forward translation of the rod causes a contact surface of the beveled tip to engage the pawl causing the fin to deploy from the slot.

Another aspect of the invention provides a projectile comprising at least one deployable fin comprising an aperture and a deflectable pawl; a rod comprising a beveled tip configured for engaging the pawl; a housing unit comprising a forward end, a rearward end, and a hollow bore longitudinally configured between the forward end and the rearward end, wherein the hollow bore is configured for receiving the rod; a pin slotted through the aperture and attaching the fin to the housing unit, wherein the pin rotationally mounts the fin to the housing unit; and a bias member engaging the rod, wherein the forward end corresponds with a forward direction of movement of the projectile and a rearward end corresponds with a rearward direction opposite the forward direction, and wherein the housing unit comprises a slot configured for permitting the fin to articulate out of the housing unit.

Furthermore, propulsion of the projectile exerts pressure (acceleration loads) on the rod, wherein the pressure causes the rod to translate in a rearward direction causing the rod to engage the pawl, wherein the pressure causes the rod to apply a compressive force on the bias member configured for storing energy, wherein the bias member is configured for releasing stored energy thereby causing the rod to translate in a forward direction, and wherein forward translation of the rod causes a contact surface of the beveled tip to engage the pawl causing the fin to deploy from the slot. Moreover, the housing unit further comprises a receptacle configured for housing the bias member and a boss configured for limiting the rod to translate in the rearward direction. Additionally, the rod is configured to simultaneously engage a plurality of fins. Also, the projectile further comprises a nose portion, a forward bore rider adjacent to the nose portion, a shell body adjacent to the forward bore rider, and an obturator disposed between the shell body and the housing unit, wherein the housing unit forms a tailboom of the projectile.

Another embodiment of the invention provides a method of deploying a fin from a full-bore artillery projectile, wherein the method comprises positioning a rotatable fin in a tailboom of the projectile, wherein the fin comprises a deflectable pawl; positioning a rod in the tailboom, wherein the rod comprises a beveled tip; exerting pressure on the rod causing the beveled tip to engage the pawl; removing the pressure from the rod; and translating the beveled tip to re-engage the pawl causing the fin to rotate out of the tailboom, wherein the projectile travels in a forward direction. Moreover, the pressure is exerted by propulsion of the projectile in the forward direction, wherein the pressure causes the rod to translate in a direction opposite the forward direction, wherein the pressure causes the rod to apply a compressive force on a bias member configured for storing energy, and wherein the bias member releases stored energy thereby causing the rod to translate in a forward direction.

The embodiments of the invention provide a device that deploys projectile stabilization fins at the appropriate time without the use of any active mechanical or electronic timing or actuation devices. The embodiments of the invention contrast conventional designs because no internally-stored energy or power source such as fuels or complex actuation devices are required. Additionally, no electromechanical mechanisms such as motors, timers or electronic circuits are required for the timing of the deployment of the stabilization fins. Rather, according to the embodiments of the invention, the impetus for fin deployment activation is the acceleration of the projectile and the associated inertial set-back forces occurring during launch. The mechanics of the embodiments of the invention results in inertial forces acting on the invention's components which results in appropriately timed fin deployment.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments of the invention will be better understood from the following detailed description with reference to the drawings, in which:

FIG. 3 is a schematic diagram of a fin-stabilized projectile according to an embodiment of the invention;

FIG. 4 is a schematic diagram of the fin of FIG. 3 according to an embodiment of the invention;

DETAILED DESCRIPTION OF PREFERRED EMBODIMENTS OF THE INVENTION

Figure 1:
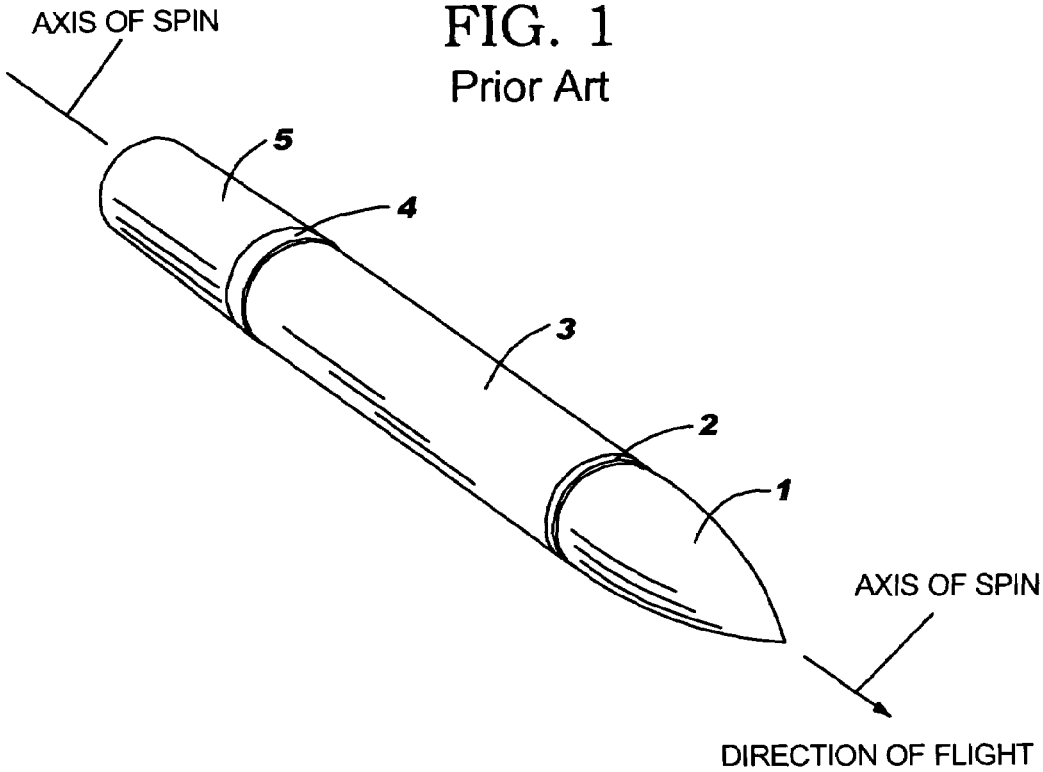
FIG. 1 Prior Art
FIG. 1 is a schematic diagram of a conventional spin stabilized projectile.
Figure 2:
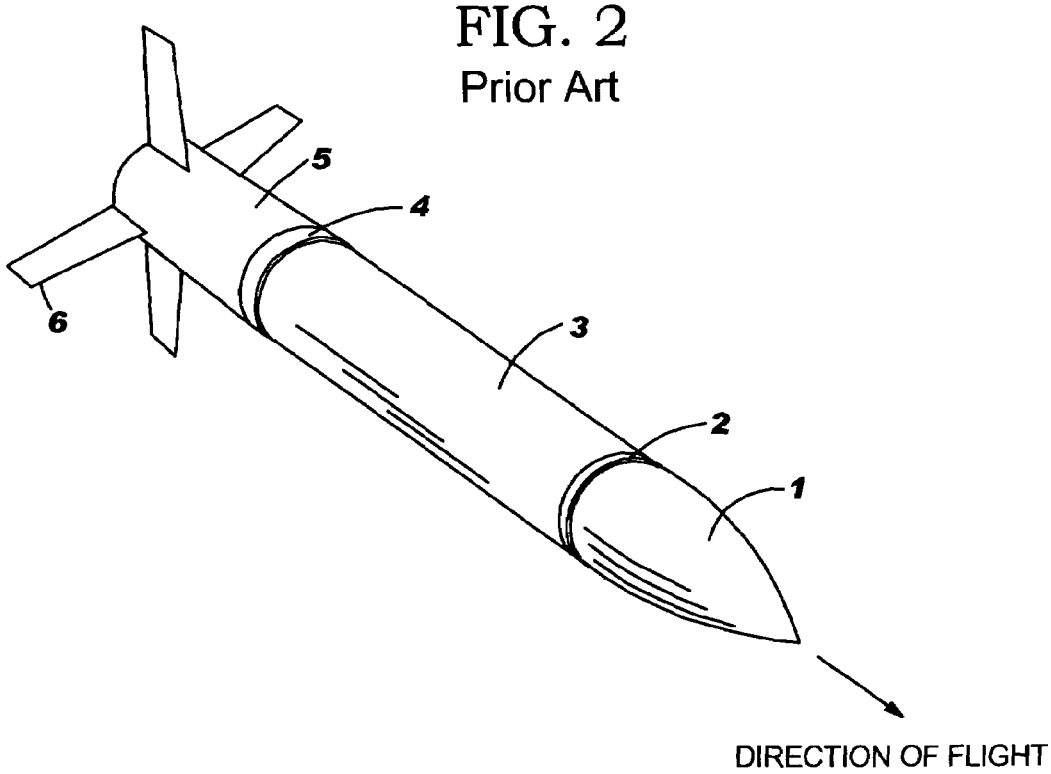
FIG. 2 Prior Art
FIG. 2 is a schematic diagram of a conventional fin-stabilized projectile.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

As mentioned, there remains a need for a novel full-bore artillery projectile fin deployment mechanism which is not dependent on the use of any complex electro-mechanical actuation devices. The embodiments of the invention solve this need by providing a mechanism for the deployment of the fins of a fin stabilized full-bore artillery projectile launched from a smoothbore cannon. The invention's novel mechanism includes an arrangement of mechanical devices that are activated by set-back accelerations occurring within the projectile during launch from a smoothbore cannon. As such, the power source for the embodiments of the invention is the naturally occurring projectile launch accelerations.

Referring now to the drawings, and more particularly to FIGS. 3 through 16, there are shown preferred embodiments of the invention. According to an embodiment of the invention, a full-bore fin stabilized artillery projectile 100, as illustrated in FIG. 3, comprises an ogive 101 adjacent to a forward bore rider 102. The forward bore rider 102 is next to a shell body 103, which is adjacent to an obturating (gas-sealing) rotating band (obturator) 104. The obturator 104 is adjacent to a tailboom 105. FIG. 3 further illustrates a fin 106 in the deployed configuration attached to the tailboom 105 of the fin-stabilized projectile 100. The tailboom 105 further comprises slots 107, which the fins 106 rotate out of during the fin deployment action. For ease of understanding, four fins 106 are illustrated in the figures and in the accompanying descriptions herein. However, those skilled in the art would readily understand that any number of fins 106 could be used in conjunction with the embodiments of the invention.

As illustrated in FIG. 4, each of the four fins 106 includes a through-hole 108 to allow a rotational degree of freedom for deployment after the projectile 100 exits the muzzle of the cannon (not shown). Preferably, at muzzle exit the fins 106 rotate out of the tailboom 105 and perform their function as aerodynamic control surfaces for stabilized projectile flight.

This fin deployment action preferably occurs within a short time (as soon as the physics of motion allow; (i.e., preferably deployment occurs as soon as the projectile 100 clears the cannon bore (not shown) and muzzle break (if so equipped)) after muzzle exit to minimize projectile yaw so the projectile 100 maintains its intended trajectory. Further, the fins 106 preferably do not deploy too soon as contact would likely occur between the fin material and the bore surface of the cannon or one of many internal surfaces of a muzzle brake (not shown). Specifically, the fins 106 preferably do not deploy any time prior to complete exit of the projectile 100 from the cannon.

Figure 5:
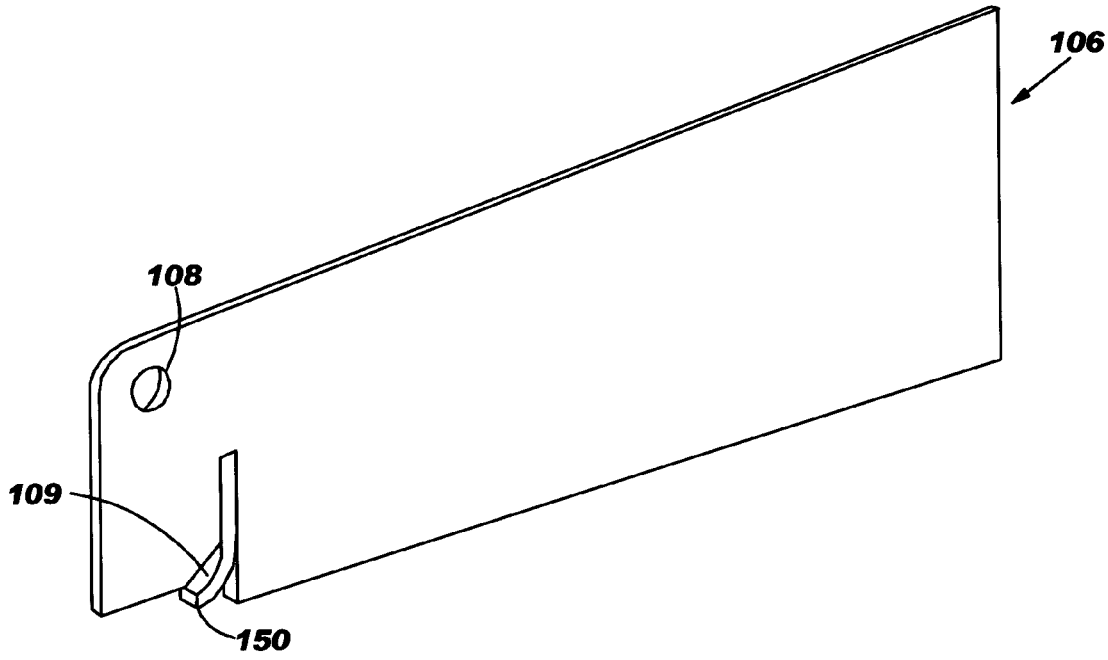
FIG. 5 is a schematic diagram of the fin FIG. 3 with the tip of the pawl deflected according to an embodiment of the invention.

Additionally, as further illustrated in FIG. 4, each of the fins 106 also preferably feature a prismatic piece of spring steel (or suitable substitute) which functions as a pawl 109. The tip 150 of the pawl 109 is capable of bending rearward from its initial non-deformed position but is not capable of bending forward past its initial non-deformed position relative to the directions shown in FIG. 4. This limited bending capability is achieved by notching the fin 106 in such a manner as to support a bearing load on the forward side (the side the pawl 109 cannot bend towards) and removing most of the material (notch 155) on the rearward side (to allow deflection of the pawl 109 in the rearward direction). FIG. 4 shows the pawl 109 in the unloaded position while FIG. 5 shows the same fin 106 with the pawl 109 in the loaded or deflected position.

Figure 6:
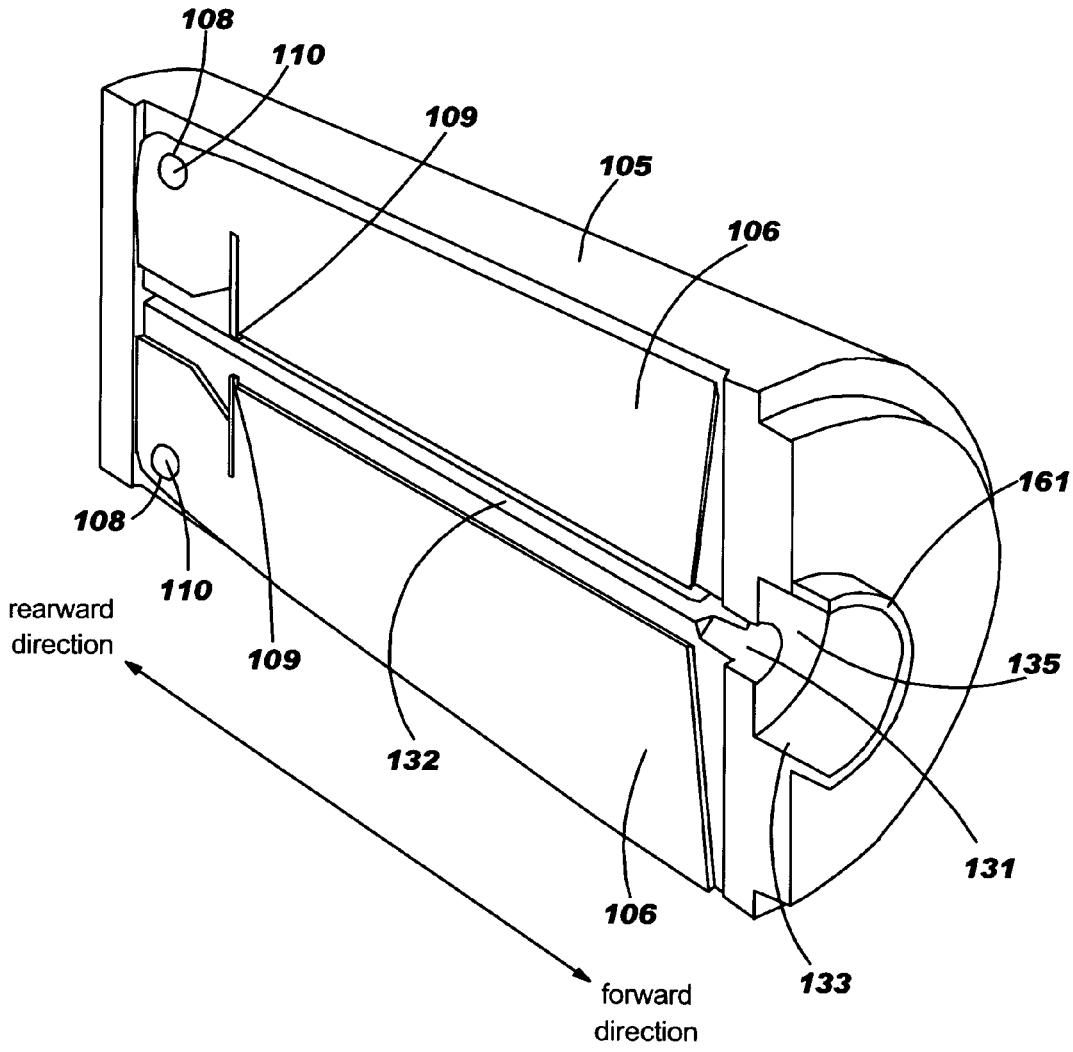
FIG. 6 is a cross-sectional diagram of the tailboom of FIG. 3 according to an embodiment of the invention.

The sequence of events leading to the various configurations assumed by the components during the successful application of the embodiments of the invention includes the following three steps. In the first step, which can be described as the pre-launch condition, the fins 106 are positioned in the slotted tailboom 105. FIG. 6 shows a cross-section of the slotted tailboom 105 and the position of two of the four fins 106 in the pre-launch configuration. The fins 106 are mounted on dowel pins 110 which pass through the through-hole 108 of each fin 106 as well as the body of the slotted tailboom 105. The dowel pins 110 permit rotation of the fin 106 in the plane in which the fins 106 lie. A central hollow bore 131 is included in the tailboom 105 to accommodate a plunger rod 111. Moreover, the tailboom 105 includes a receptacle 133 configured for housing a bias member 116 (shown in FIG. 8).

Figure 7:
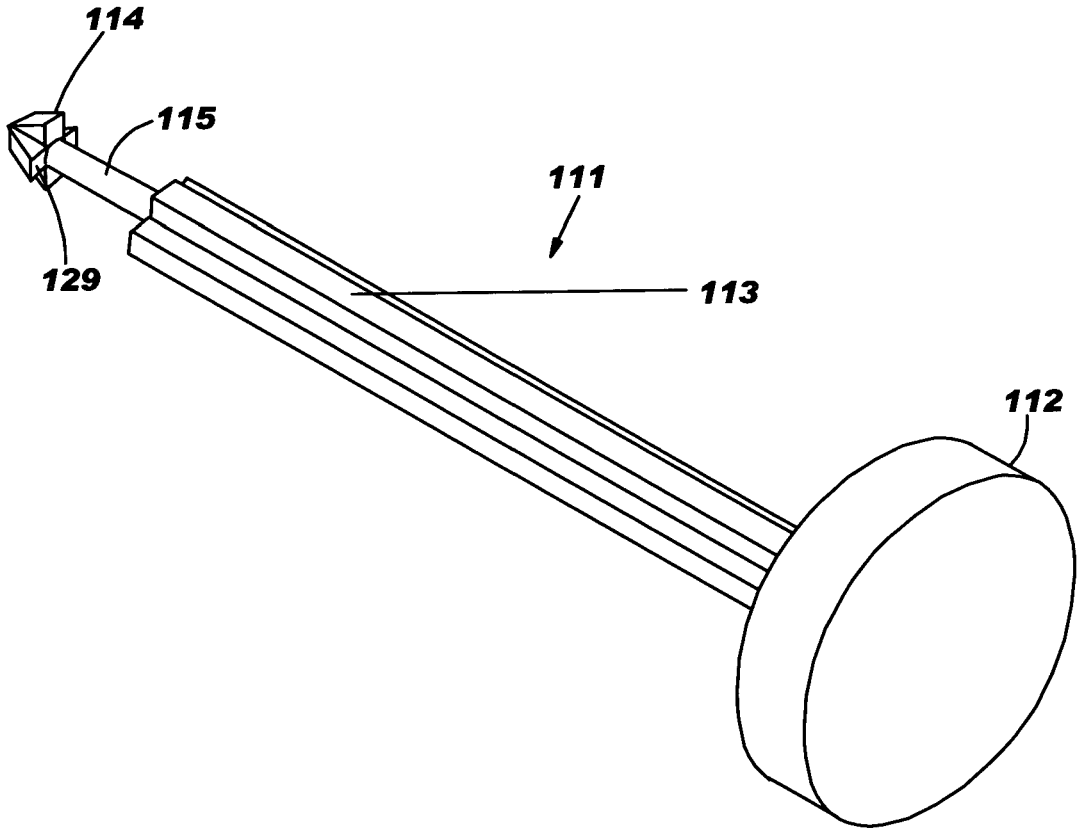
FIG. 7 is a schematic diagram of a plunger rod assembly according to an embodiment of the invention.

The slotted plunger rod 111, which is shown separately in FIG. 7, comprises a generally flat weighted head portion 112. Moreover, a shaft 113 extends from the head portion 112. In one embodiment, the shaft 113 is configured with four identical slotted sides, which are generally configured in rectangular block portions. The number of slotted sides is dependent on the number of fins 106. Again, for ease of understanding, four fins 106, and thus, four slotted sides of the shaft 113 are illustrated in the drawings and described herein. As shown in FIG. 6, the central hollow bore 131 of the tailboom 105 includes four slotted guides 132 to accept each one of the rectangular block portions of the shaft 113 of the plunger rod 111. Similarly, the number of slotted guides 132 is dependent on the number of fins 106. Alternatively, the shaft 113 may be cylindrically configured. As best seen in FIG. 7, the shaft 113 terminates with a generally cylindrical portion 115 with a notched end or beveled tip 114 having a catch surface 129 on the end opposite the head portion 112. The beveled tip 114 comprises four identical beveled sides (one bevel side surface per fin 106).

Figure 8:
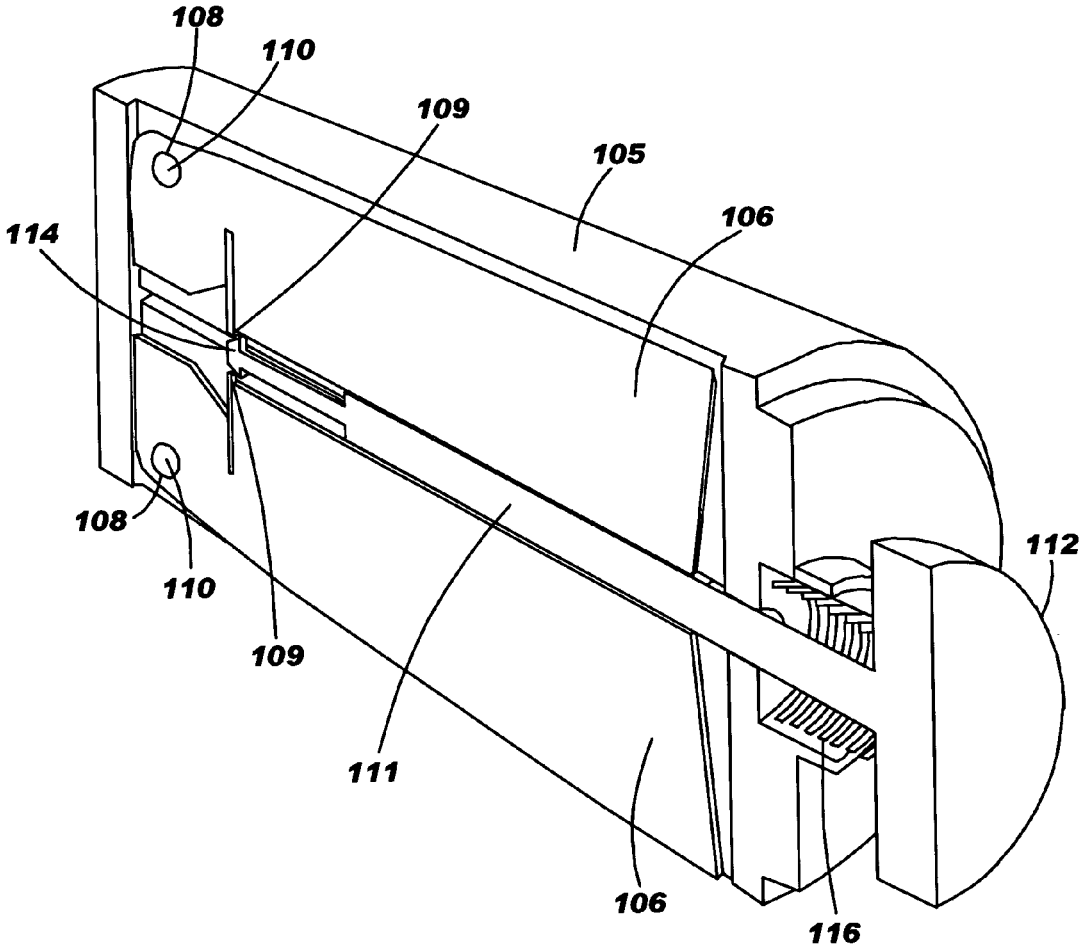
FIG. 8 is a cross-sectional diagram of the tailboom of FIG. 3 including the non-activated plunger rod assembly of FIG. 7 according to an embodiment of the invention.

The pre-launch position of the plunger rod 111 relative to the invention assembly is shown in FIG. 8. FIG. 8 also shows the bias member 116, preferably configured as a plunger rod return spring, which is positioned in the receptacle 133 (best seen in FIG. 6), wherein the bias member 116 is positioned between the weighted head portion 112 of the plunger rod 111 and the forward surface 135 (best seen in FIG. 6) of the slotted tailboom 105. In the pre-launch configuration, the beveled tip 114 of the plunger rod 111 is forward of the pawls 109 mounted to the individual fins 106.

The second step in the sequence of events occurs during the combustion of propellant when pressure acts on all exposed projectile components rear of the obturator 104. The pressure generated in the chamber of the cannon (not shown) acts normal to exposed surfaces of the tailboom 105 and the exposed edges of the fins 106. This pressure acts to keep the fins 106 in the tailboom 105 as the entire projectile 100 begins to accelerate along the bore of the cannon. In addition to the pressure acting to keep the fins 106 in the tailboom 105, the center of gravity of the fins 106 is, by design, inboard of the dowel pins 110 for each of the fins 106. This eccentricity between the dowel pins 110 and the center of gravity of the fins 106 act to create a moment force acting on the fin 106 causing rotation of the fin 106 inwards, toward the center of the projectile 100. Simple mechanical interference between the fin 106 and the presence of any material in the slotted tailboom 105 prevents excessive rotation of the fins 106 inward towards the centerline of the projectile 100.

Figure 9:
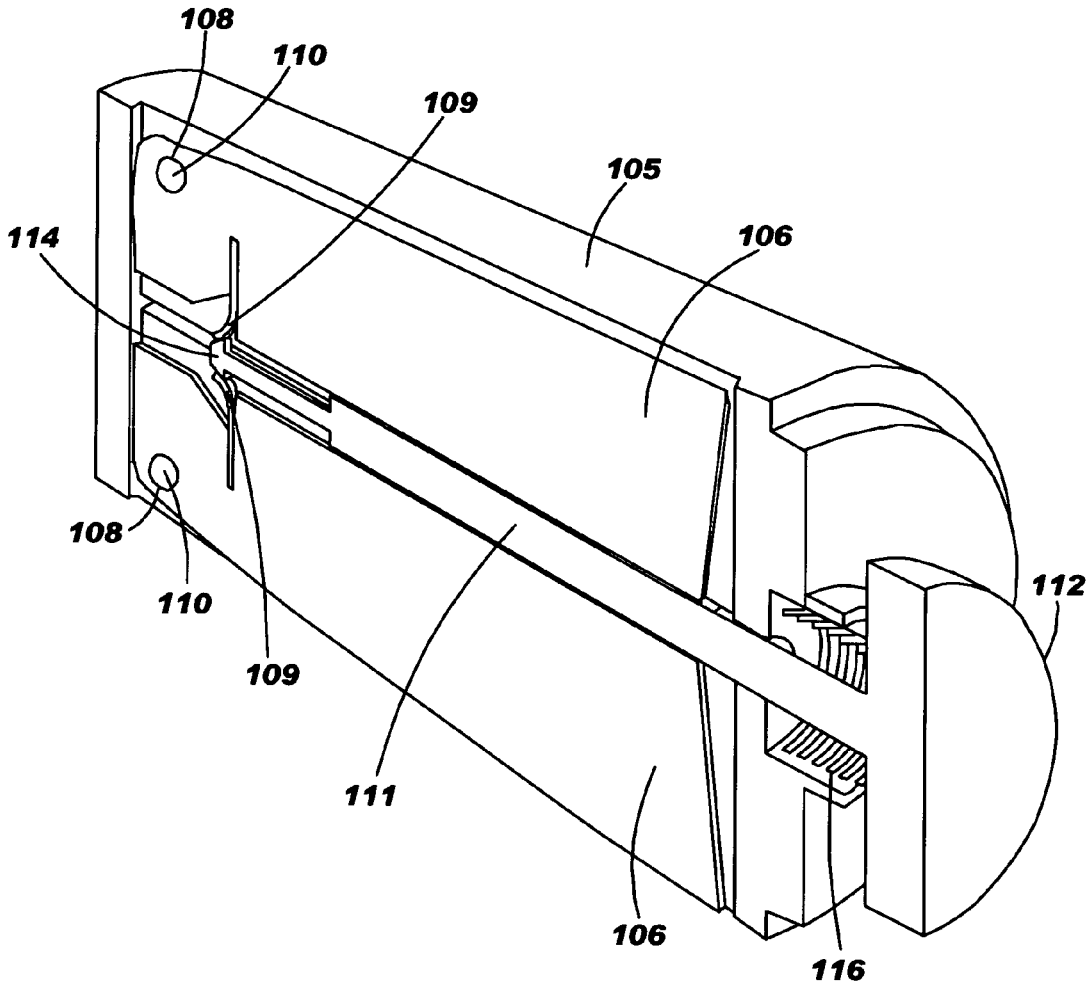
FIG. 9 is a cross-sectional diagram of the tailboom of FIG. 3 including the partially-activated plunger rod assembly of FIG. 7 according to an embodiment of the invention.
Figure 10:
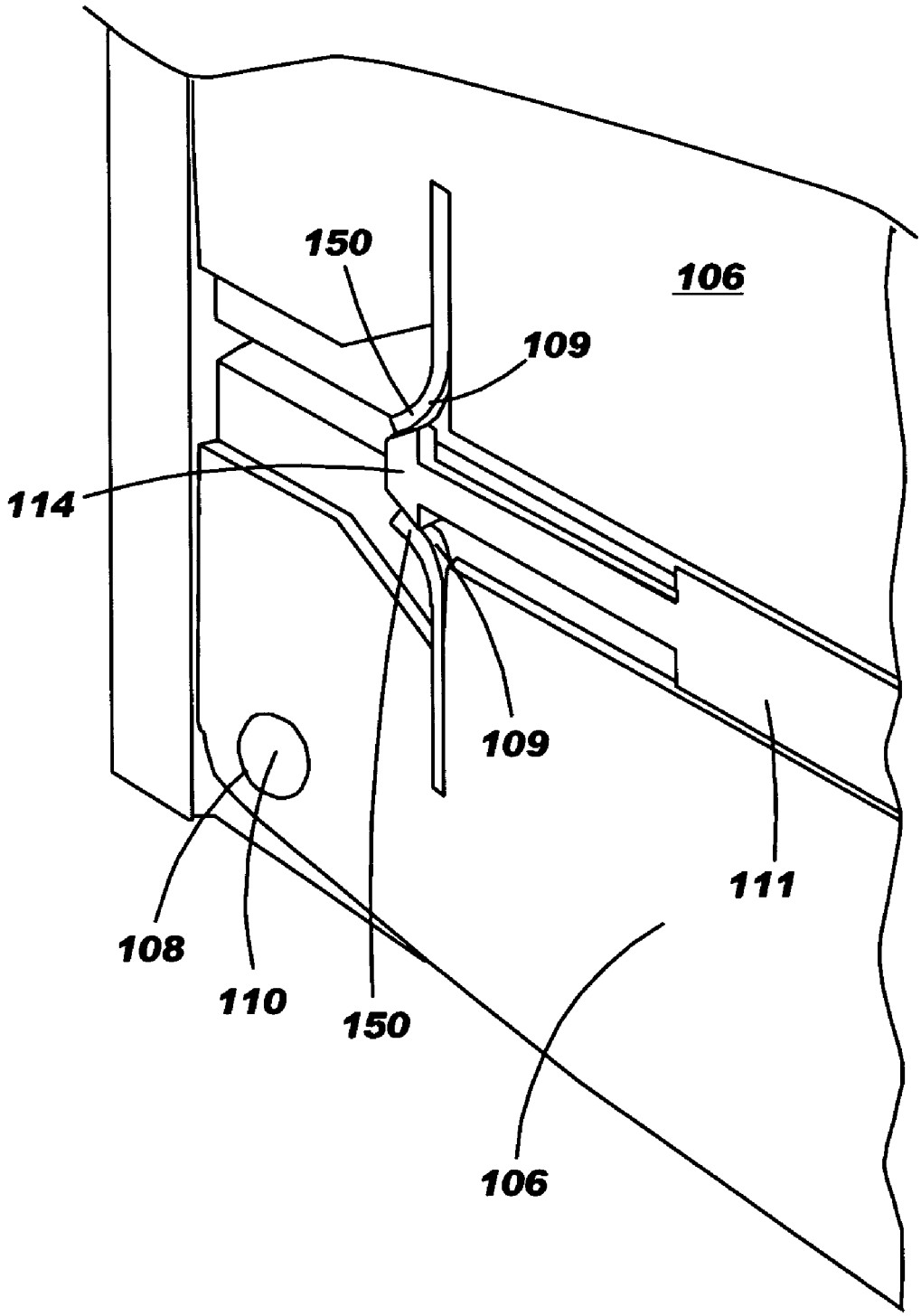
FIG. 10 is a magnified cross-sectional diagram of the tailboom of FIG. 9 according to an embodiment of the invention.

While the projectile 100 accelerates forward, the inertial forces acting on all non-constrained internal components of the slotted tailboom 105 cause the non-constrained components to accelerate rearward relative to the projectile 100. In particular, the plunger rod 111 translates towards the rear of the projectile 100 and both impacts and causes the deflection of the tip 150 of each pawl 109. FIG. 9 depicts the exact instant the beveled tip 114 of the plunger rod 111 impacts and deflects the pawl 109 of each fin 106. A magnified view of the contact between the beveled tip 114 of the plunger rod 111 and the tips 150 of the pawls 109 is shown in FIG. 10.

Figure 11:
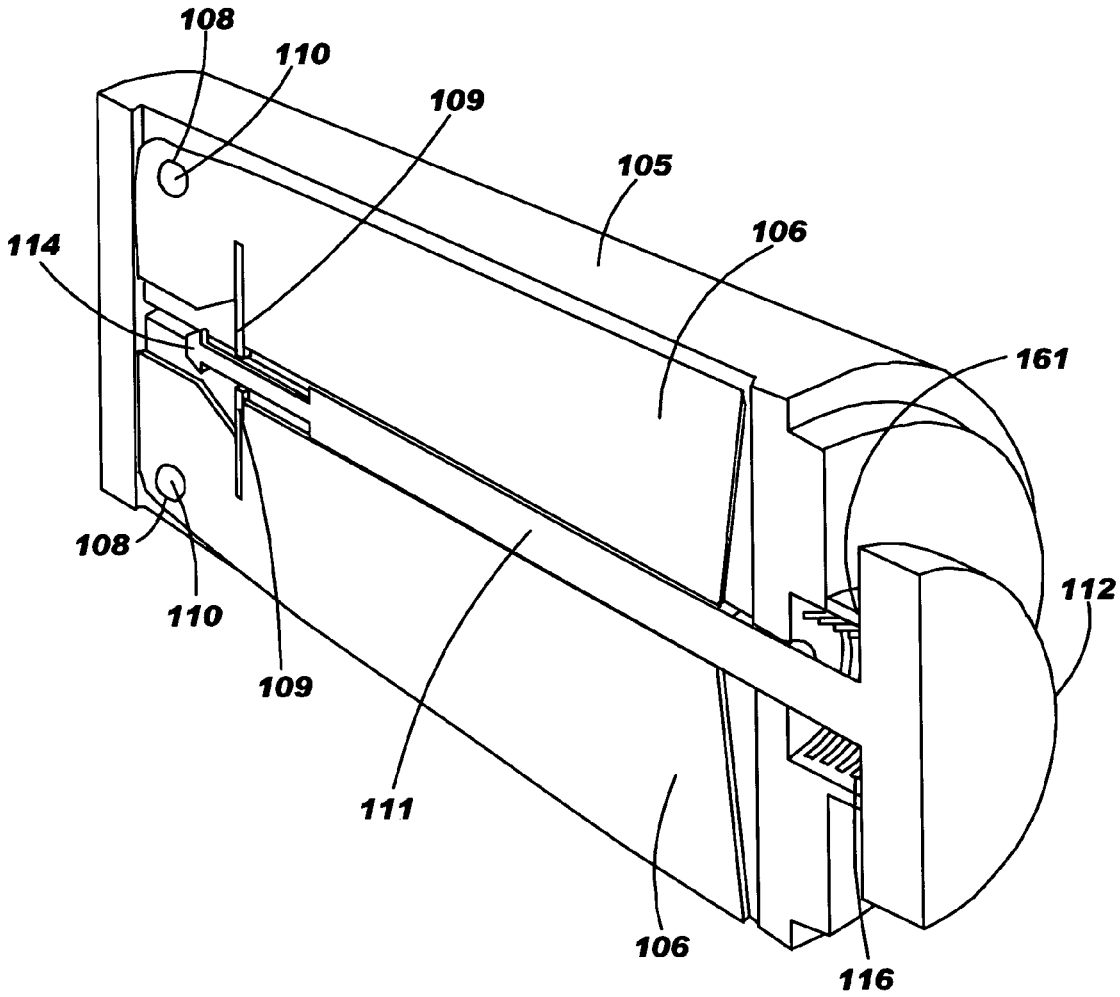
FIG. 11 is a cross-sectional diagram of the tailboom of FIG. 3 including the fully-activated plunger rod assembly of FIG. 7 according to an embodiment of the invention.
Figure 12:
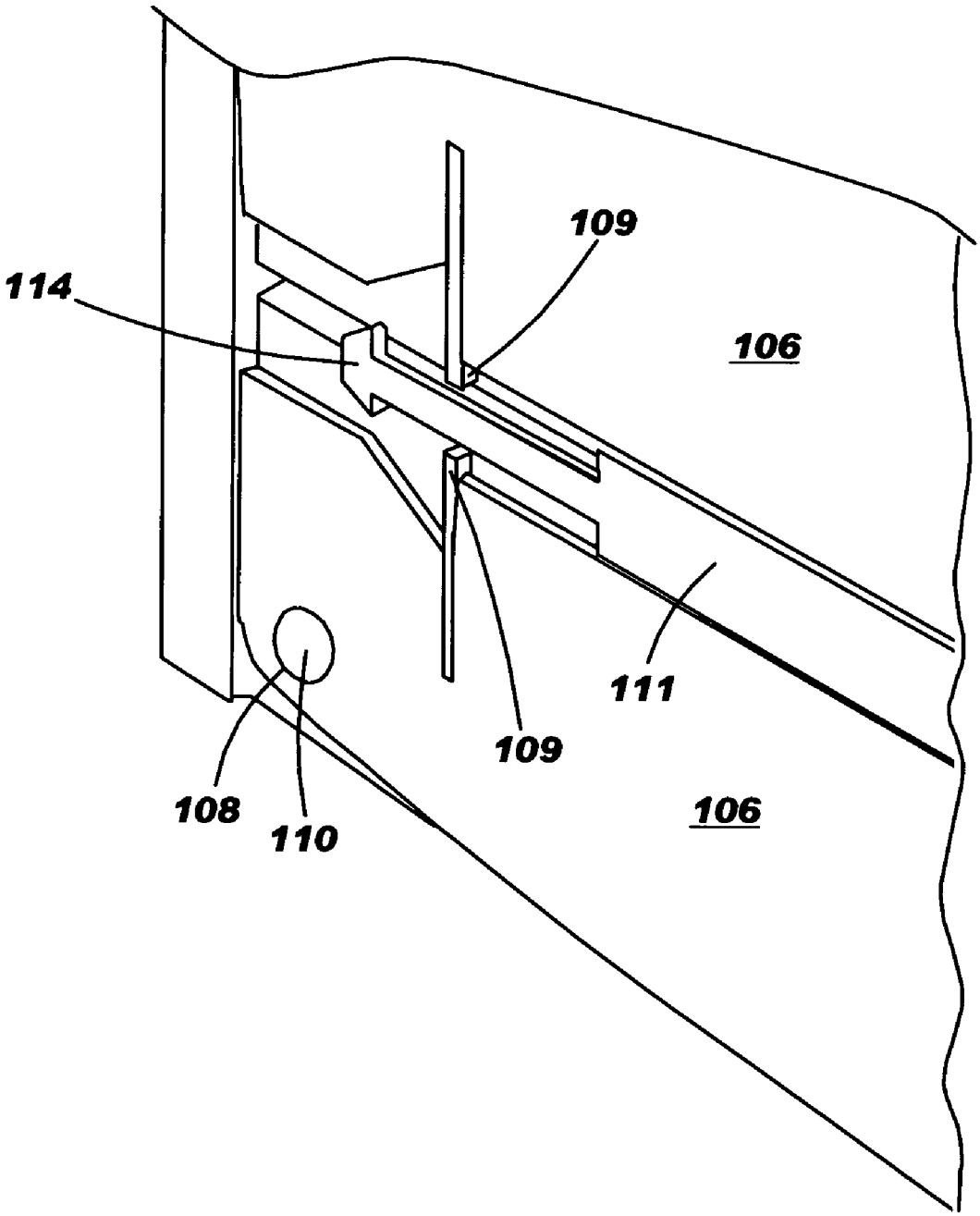
FIG. 12 is a magnified cross-sectional diagram of the tailboom of FIG. 11 according to an embodiment of the invention.

FIG. 11 shows the configuration of the invention components after the beveled tip 114 of the plunger rod 111 has translated past the deflected pawls 109. The pawls 109 recover to their original non-deflected configuration and the bias member 116 is compressed due to the inertial forces acting on the weighted head portion 112 of the plunger rod 111, which results in the rearward translation of the plunger rod 111. This rearward translation of the plunger rod 111 continues until the weighted head portion 112 of the plunger rod 111 impacts the boss feature 161, which is configured as a generally circular projecting wall, of the tailboom 105. FIG. 12 is a magnified view of the beveled tip 114 of the plunger rod 111 after it has translated past the pawls 109 and the pawls 109 have recovered to their original non-deflected configurations.

The third step in the sequence of events occurs after the projectile 100 has exited the muzzle of the cannon (not shown) and the projectile 100, as a whole, is no longer accelerating in the forward direction. Subject to this condition, the weighted head portion 112 of the plunger rod 111 no longer applies a compression force on the bias member 116. Thus, the bias member 116 begins to release its stored energy acquired by compression when the weighted head portion 112 of the plunger rod 111 translates rearward and compresses the bias member 116, and elongates thereby pushing on and causing the translation of the plunger rod 111 in the forward direction. As the plunger rod 111 translates forward, it generates forward momentum equal to the mass of the plunger rod 111 multiplied by the instantaneous velocity of the plunger rod 111. As such, as the plunger rod 111 translates forward, contact occurs between the pawls 109 mounted on each of the fins 106 and the catch surface 129 of the beveled tip 114 of the plunger rod 111.

Unlike the deflection of the pawls 109 occurring when the plunger rod 111 translated in the rearward direction, the pawls 109 are not capable of deflecting a sufficient amount to allow passage of the beveled tip 114 of the plunger rod 111 in the forward direction. Consequently, the contact force (or impact impulse) is applied from the forward translating beveled tip 114 of the plunger rod 111 to the rear surface 157 (best seen in FIG. 4) of the pawls 109 resulting in a moment force (torque due to the eccentricity of the line of force of the impact relative to the constraint) being applied to the fins 106 thereby causing a rotation of the fins 106 about the dowel pins 110 fixed to the tailboom 105.

Figure 13:
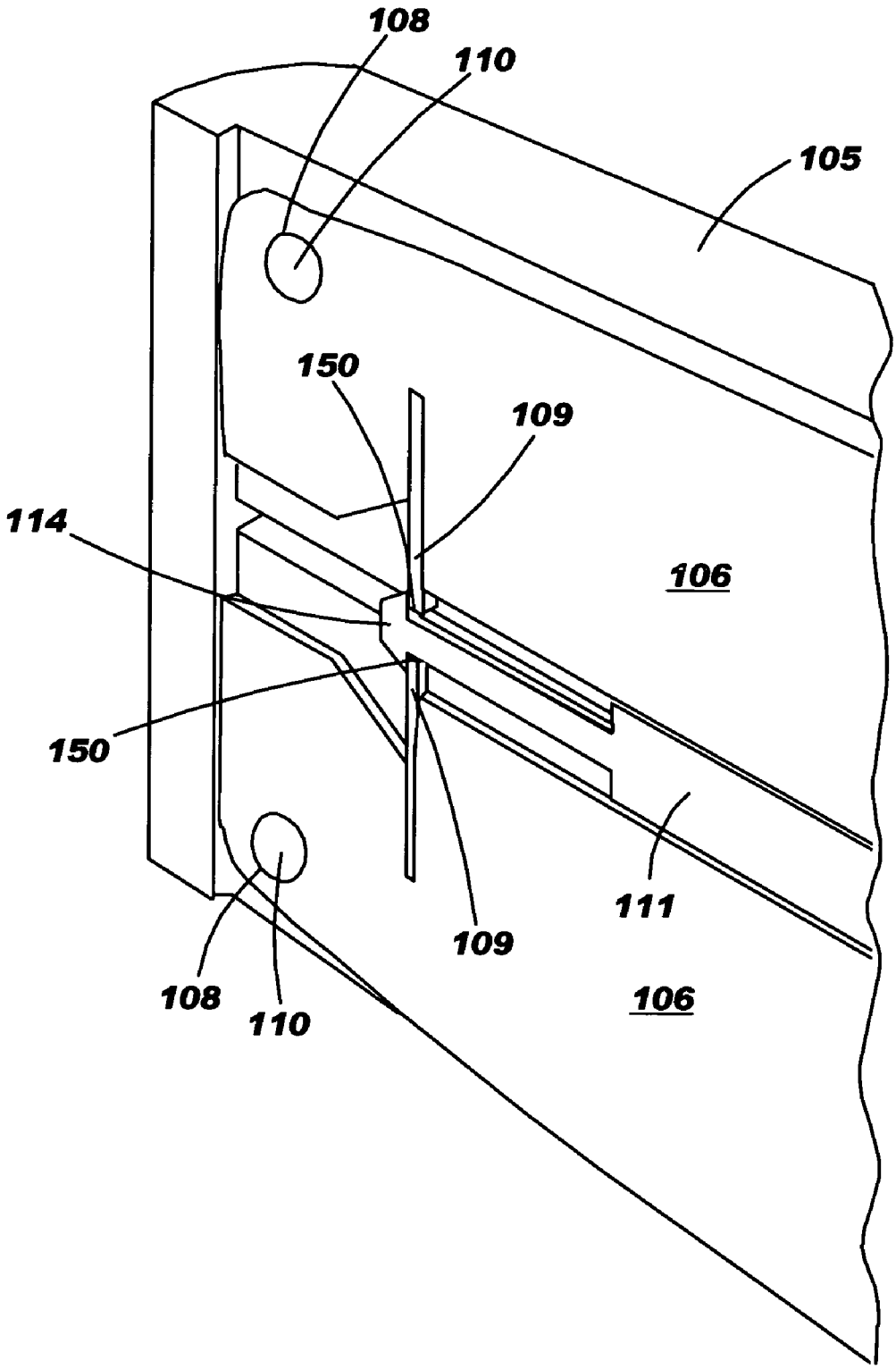
FIG. 13 is a magnified cross-sectional diagram of the tailboom of FIG. 3 according to an embodiment of the invention.

FIG. 13 shows the mechanical interference occurring between the forward translating plunger rod 111 and the rear surface 157 (best seen in FIG. 4) of the pawls 109. FIG. 13 identifies the locations where contact between a first and second pawl 109 is made with the catch surface 129 of the beveled tip 114 of the plunger rod 111.

Because the bias member 116 has not fully recovered to its unloaded length at the time of impact between the pawls 109 of the stowed fins 106 and the beveled tip 114 of the plunger rod 111, the translation of the plunger rod 111 continues translating forward by rotating the fins 106 which contain the pawls 109 outboard from the tailboom 105 as part of the deployment action of the fin 106. The angular velocity of each of the four fins 106 can be estimated by equating the linear momentum of the plunger rod 111 to the angular momentum of the four fins 106 plus the post impact linear velocity of the plunger rod 111.

Figure 14:
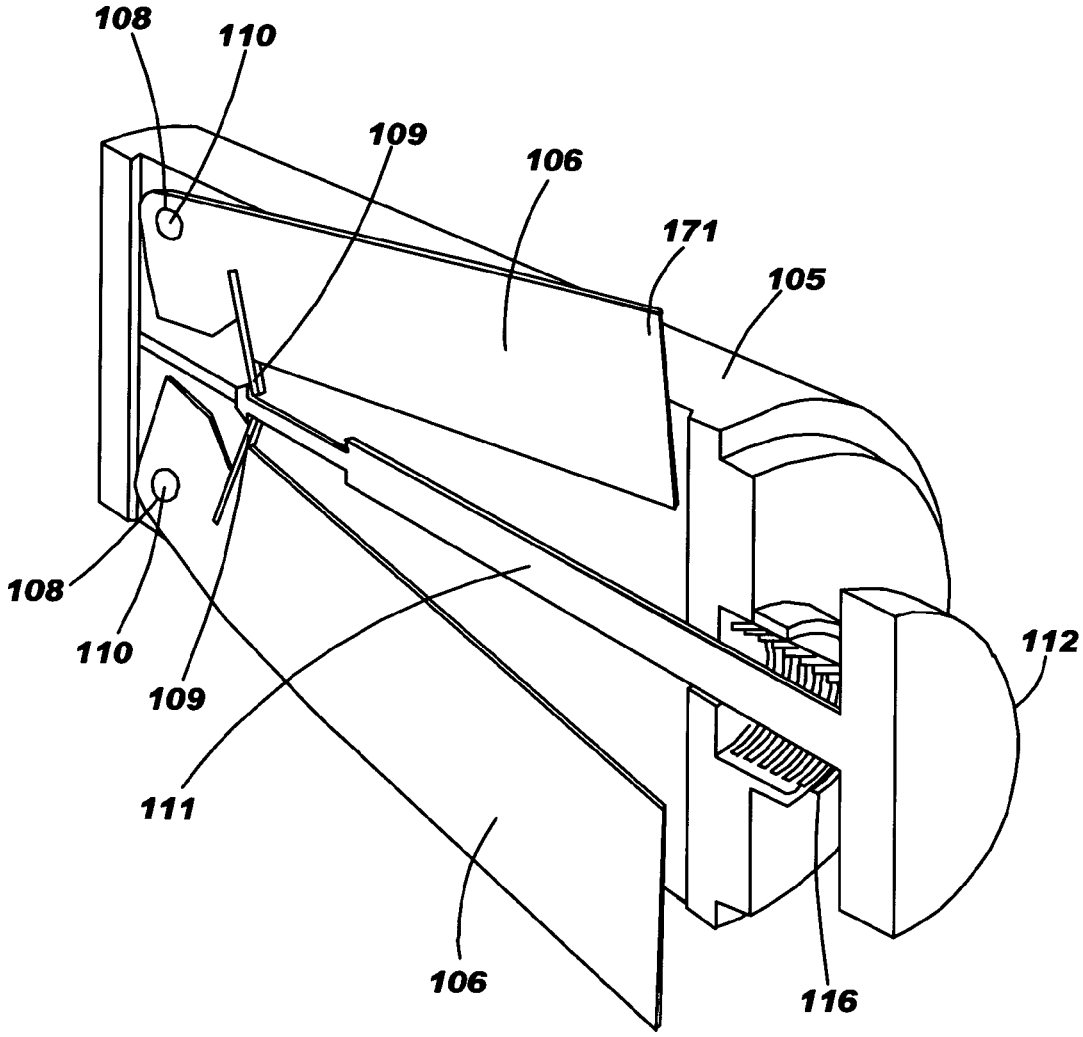
FIG. 14 is a cross-sectional diagram of the tailboom of FIG. 3 with partial fin deployment according to an embodiment of the invention.
Figure 15:
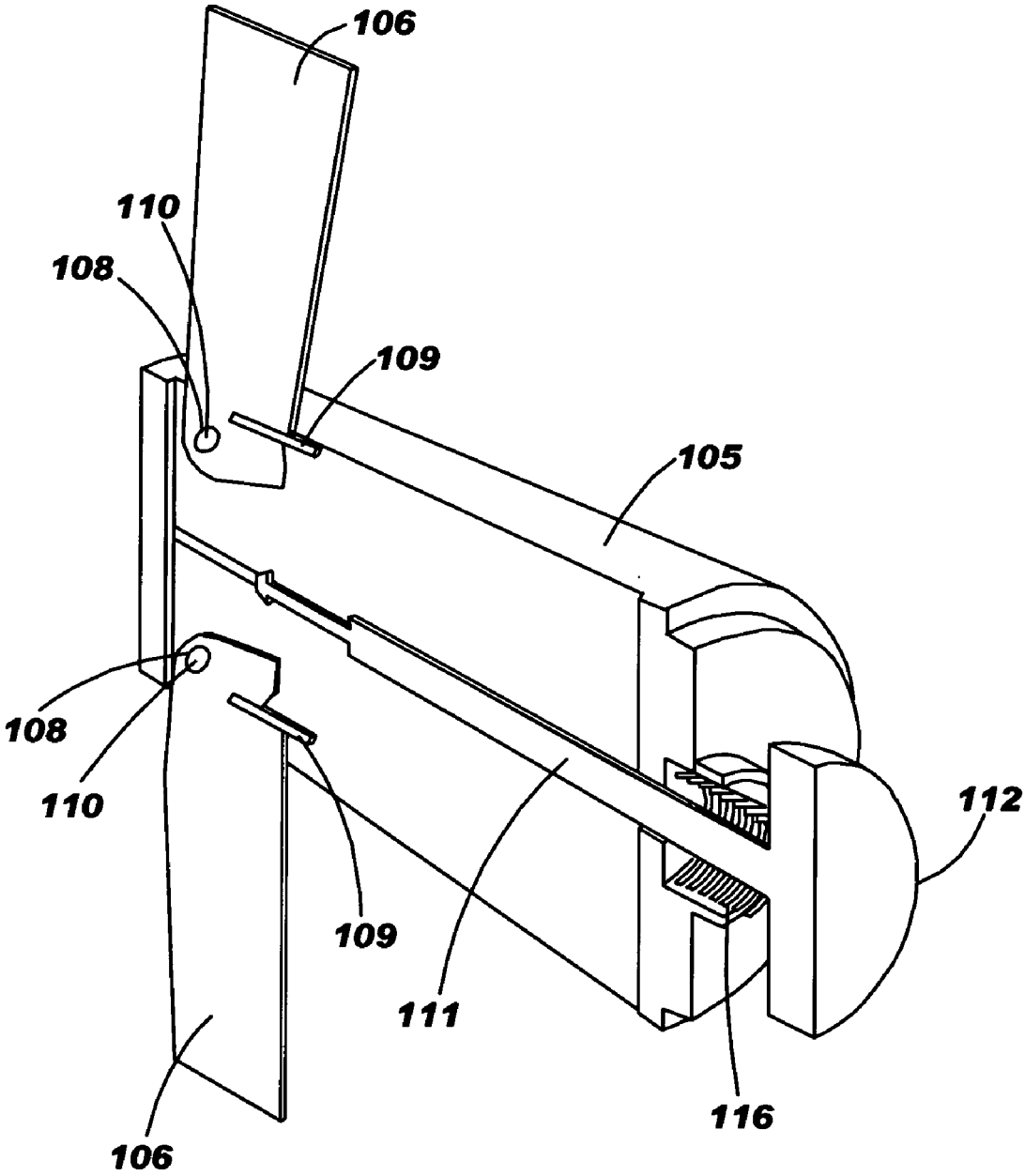
FIG. 15 is a cross-sectional diagram of the tailboom of FIG. 3 will full fin deployment according to an embodiment of the invention.

FIG. 14 shows the rotation of the fins 106 required for the plunger rod 111 to continue translating in the forward direction which occurs because the bias member 116 pushes the plunger rod 111 forward. The outward rotation of the fins 106 result in the forward portion 171 of the fins 106 being exposed to the air-stream passing over the surface of the projectile 100 while the projectile 100 is in flight. The air-stream impacts the forward most surface of the fins 106 which are oriented at an oblique angle of attack relative to the air-stream thereby applying a continued torque to the fins 106 which causes them to rotate into the fully deployed configuration. Rotation of the fins 106 cease when the fins 106 are generally in a transverse orientation compared to the tailboom 105 and the fins 106 contacts the end of the slotted portion 107 of the tailboom 105. Forward translation of the plunger rod 111 ceases by impact and contact with any internal component configured to accept the impact located within the shell body 103. FIG. 15 is a cross-section of an embodiment of the invention showing the fins 106 in the deployed position.

The embodiments of the invention include various configurations during and after projectile launch from a smooth-bore gun tube (not shown). The translations of invention components occurring during launch are intentional and restricted in their translational and rotational degrees of freedom as described above to result in the deployment of the projectile stabilization fins 106. As previously described, the deployment of the fins 106 occurs after the projectile 100 has exited the launch cannon (not shown) and the acceleration of the projectile 100 has ceased. The velocity of the projectile 100 after exiting the muzzle of the cannon is sufficient for the projectile 100 to continue on its trajectory with fins 106 fully deployed. The accelerations and forces occurring during projectile launch provide the impetus for the invention's components to function as described above. Both the bias member 116 and the pawl 109 bear no loads or deformations in the pre-launch configuration and therefore are not sources of stored energy.

The lack of a stored energy source is a desirable feature from the perspective of desiring to acquire and store a reserve of fin stabilized artillery projectiles 100. More particularly, without stored energy sources, there is no need to maintain a stored energy device while in long term storage, which would require additional maintenance such as checking and replacing batteries, etc. Thus, without having stored energy sources, the embodiments of the invention facilitate the saving of money, time, and manpower resources, etc., and eliminate the risk of fin deployment system malfunctions as the embodiments of the invention deploy the fins 106 by naturally occurring acceleration loads; i.e., the projectile 100 accelerates in the cannon bore (not shown) while the fins 106 are stowed, and after muzzle exit, the projectile 100 no longer accelerates so the bias member 116, which retains its original strength because it was not stored in a compressed configuration, then powers the deployment of the projectile 100.

Figure 16:
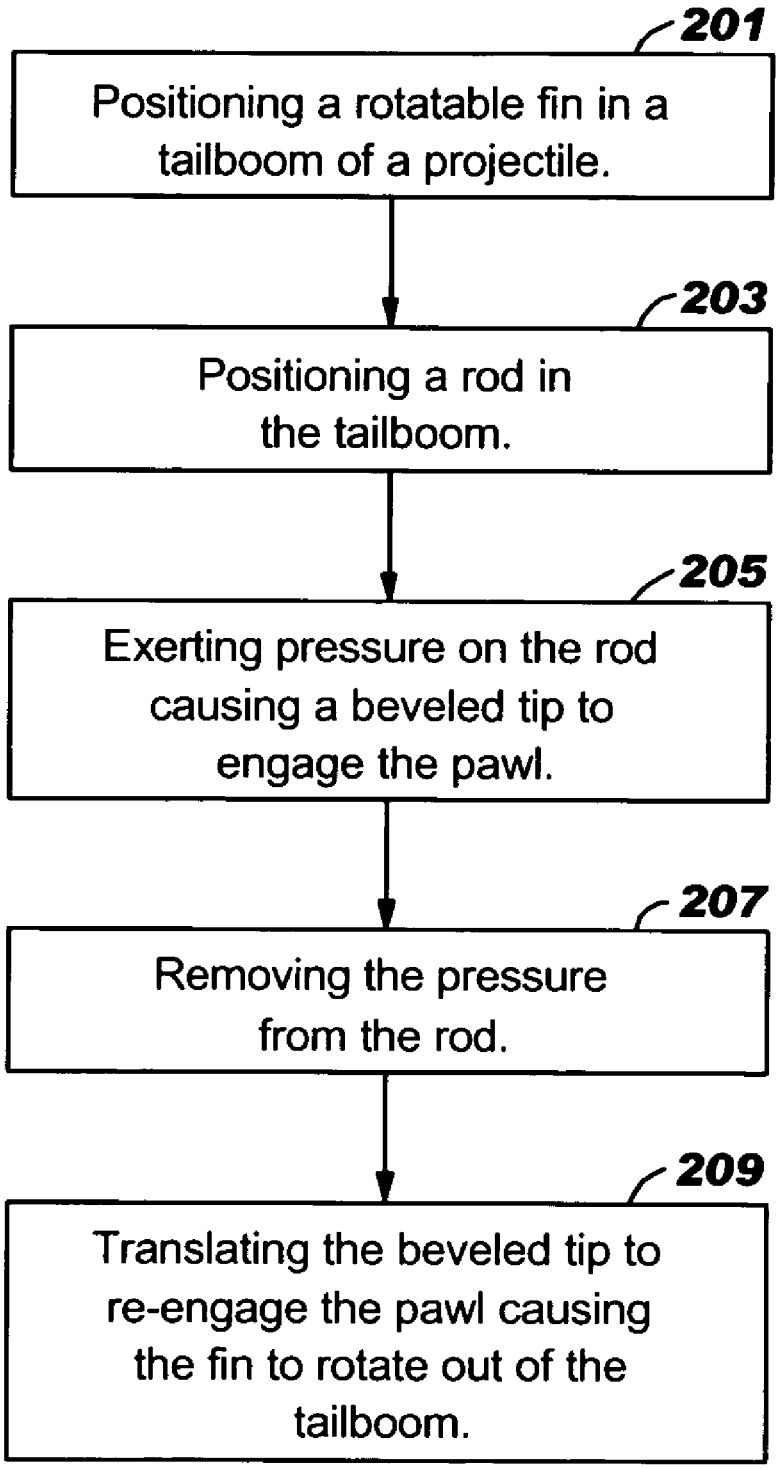
FIG. 16 is a flow diagram illustrating a preferred method of an embodiment of the invention.

FIG. 16 which includes descriptions which refer to components provided in FIGS. 3 through 15, illustrates a method of deploying a fin 106 from a full-bore artillery projectile 100, according to an embodiment of the invention, wherein the method comprises positioning (201) a rotatable fin 106 in a tailboom 105 of the projectile 100, wherein the fin 106 comprises a deflectable pawl 109. The next step involves positioning (203) a rod 111 in the tailboom 105, wherein the rod 111 comprises a beveled tip 114. Then, the method involves exerting (205) pressure on the rod 111 causing the beveled tip 114 to engage the pawl 109. Thereafter, the method includes removing (207) the pressure from the rod 111 and translating (209) the beveled tip 114 to re-engage the pawl 109 causing the fin 106 to rotate out of the tailboom 105, wherein the projectile 100 travels in a forward direction. Moreover, the pressure is exerted by propulsion of the projectile 100 in the forward direction, wherein the pressure causes the rod 111 to translate in a direction opposite the forward direction, wherein the pressure causes the rod 111 to apply a compressive force on a bias member 116 configured for storing energy, and wherein the bias member 116 is configured for releasing stored energy thereby causing the rod 111 to translate in a forward direction.

Generally, the embodiments of the invention provide a device that deploys projectile stabilization fins 106 at the appropriate time without the use of any active mechanical or electronic timing or actuation devices. Specifically, the embodiments of the invention provide a device that deploys projectile stabilization fins 106, which is powered entirely by inertial accelerations occurring within the projectile during the launch event. Accordingly, the embodiments of the invention provide a projectile 100 or vehicle that changes geometric configurations after a launch operation during which time naturally occurring acceleration loads power an assembly or device which reconfigures the geometry of the projectile 100 after the acceleration loads are removed. The embodiments of the invention may be implemented in several applications such as: fins of an archer's arrow, air launched missiles, gun launched projectiles, and ground vehicles, etc.

The embodiments of the invention contrast conventional designs because no internally-stored energy or power source such as fuels or complex pre-compressed springs are required prior to launch. Additionally, no electromechanical mechanisms such as motors, timers or electronic circuits are required for the timing of the deployment of the stabilization fins 106. Rather, according to the embodiments of the invention, the impetus for fin deployment activation is the acceleration of the projectile 100 and the associated inertial set-back forces occurring during launch. The mechanics of the embodiments of the invention results in inertial forces acting on the invention's components which results in appropriately timed fin deployment. An appropriately timed fin deployment can be described as occurring after the projectile 100 has exited the cannon and is clear of interference with the cannon bore surface and muzzle brake features.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the invention has been described in terms of preferred embodiments, those skilled in the art will recognize that the embodiments of the invention can be practiced with modification within the spirit and scope of the appended claims.

What is claimed is:

1. A full-bore artillery projectile fin deployment device comprising:

at least one projectile stabilization fin comprising an aperture and a movable pawl;

a rod comprising a head portion and a shaft portion terminating with a beveled tip configured for engaging said pawl;

a tailboom configured for housing said fin, wherein said tailboom comprises a hollow bore configured for receiving said rod;

a pin slotted through said aperture and attached to said tailboom; and a bias member adjacent to said head portion of said rod.

2. The device of claim 1, wherein said tailboom comprises a forward end and a rearward end.

3. The device of claim 2, wherein said tailboom comprises a slot configured for permitting said fin to articulate out of said tailboom, and wherein said tailboom connects to a projectile.

4. The device of claim 3, wherein propulsion of said projectile exerts pressure on said rod.

5. The device of claim 4, wherein said pressure causes said rod to translate in a direction towards said rearward end of said tailboom thereby causing said rod to engage said pawl.

6. The device of claim 5, wherein said tailboom further comprises:

a receptacle configured for housing said bias member; and a boss configured for limiting translation of said rod in said direction towards said rearward end of said tailboom.

7. The device of claim 4, wherein said pressure causes said head portion of said rod to apply a compressive force on said bias member configured for storing energy.

8. The device of claim 7, wherein said bias member is configured for releasing stored energy thereby causing said rod to translate in a direction towards said forward end of said tailboom.

9. The device of claim 8, wherein forward translation of said rod causes a contact surface of said beveled tip to engage said pawl causing said fin to deploy from said slot.

10. The device of claim 1, wherein said rod is slotted to simultaneously engage a plurality of fins.

11. A projectile comprising:

at least one deployable fin comprising an aperture and a deflectable pawl;

a rod comprising a beveled tip configured for engaging said pawl;

a housing unit comprising a forward end, a rearward end, and a hollow bore longitudinally configured between said forward end and said rearward end, wherein said hollow bore is configured for receiving said rod;

a pin slotted through said aperture and attached to said housing unit, wherein said pin rotationally mounts said fin to said housing unit; and a bias member configured for engaging said rod.

12. The projectile of claim 11, wherein said forward end corresponds with a forward direction of movement of said projectile and a rearward end corresponds with a rearward direction opposite said forward direction.

13. The projectile of claim 12, wherein said housing unit comprises a slot configured for permitting said fin to articulate out of said housing unit.

14. The projectile of claim 13, wherein propulsion of said projectile exerts pressure on said rod.

15. The projectile of claim 14, wherein said pressure causes said rod to translate in a rearward direction and engage said pawl.

16. The projectile of claim 15, wherein said housing unit further comprises:

a receptacle configured for housing said bias member; and a boss configured for limiting translation of said rod in said rearward direction.

17. The projectile of claim 14, wherein said pressure causes said rod to apply a compressive force on said bias member configured for storing energy.

18. The projectile of claim 17, wherein said bias member is configured for releasing stored energy thereby causing said rod to translate in a forward direction.

19. The projectile of claim 18, wherein forward translation of said rod causes a contact surface of said beveled tip to engage said pawl causing said fin to deploy from said slot.

20. The projectile of claim 11, wherein said rod is configured to simultaneously engage a plurality of fins.

21. The projectile of claim 11 further comprising:

a nose portion;

a forward bore rider adjacent to said nose portion a shell body adjacent to said forward bore rider; and an obturator disposed between said shell body and said housing unit, wherein said housing unit forms a tailboom of said projectile.

22. A method of deploying a fin from a full-bore artillery projectile, said method comprising:

positioning a rotatable fin in a tailboom of said projectile, said fin comprising a deflectable pawl;

positioning a rod in said tailboom, said rod comprising a beveled tip;

exerting pressure on said rod causing said beveled tip to engage said pawl;

removing said pressure from said rod; and translating said beveled tip to re-engage said pawl causing said fin to rotate out of said tailboom.

23. The method of claim 22, wherein said pressure is exerted by propulsion of said projectile in a forward direction.

24. The method of claim 22, wherein said pressure causes said rod to translate in a direction opposite a forward direction.

25. The method of claim 22, wherein said pressure causes said rod to apply a compressive force on a bias member configured for storing energy.

26. The method of claim 25, wherein said bias member releases stored energy thereby causing said rod to translate in a forward direction.

* * * * *